United States Patent [19]

Astwood et al.

[11] Patent Number: 4,729,203

[45] Date of Patent: Mar. 8, 1988

[54] BAGGING MACHINES

[75] Inventors: William J. Astwood, Palmerston North; Rodney J. Lawrence, Feilding, both of New Zealand

[73] Assignee: Minigrip, Inc., Orangeburg, N.Y.

[21] Appl. No.: 900,461

[22] Filed: Aug. 26, 1986

[30] Foreign Application Priority Data

Aug. 29, 1985 [NZ] New Zealand ..... 213300

[51] Int. Cl.[4] ..... B65B 57/02

[52] U.S. Cl. ..... 53/64; 53/384; 53/570

[58] Field of Search ..... 53/64, 570, 384, 385, 53/386, 469, 473

[56] References Cited

U.S. PATENT DOCUMENTS

| | | | |
|---|---|---|---|
| 3,453,799 | 7/1969 | Cloud et al. | 53/570 X |
| 3,597,895 | 8/1971 | Jensen | 53/570 X |
| 3,599,388 | 8/1971 | Feingold | 53/570 X |
| 4,054,016 | 10/1977 | van Keulen | 53/64 |
| 4,620,411 | 11/1986 | Schieser et al. | 53/570 |

*Primary Examiner*—James F. Coan

*Attorney, Agent, or Firm*—Kane, Dalsimer, Sullivan, Kurucz, Levy, Eisele & Richard

[57] ABSTRACT

The object of the present invention is to provide a bagging machine which handles bags linked together in a chain-like arrangement, the machine being of a construction that the movement of the chain of bags is controlled such that the bags in the chain, especially those in the filling zone and lead up to the filling zone, can be precisely positioned.

1 Claim, 5 Drawing Figures

Figures 1A, 1B:
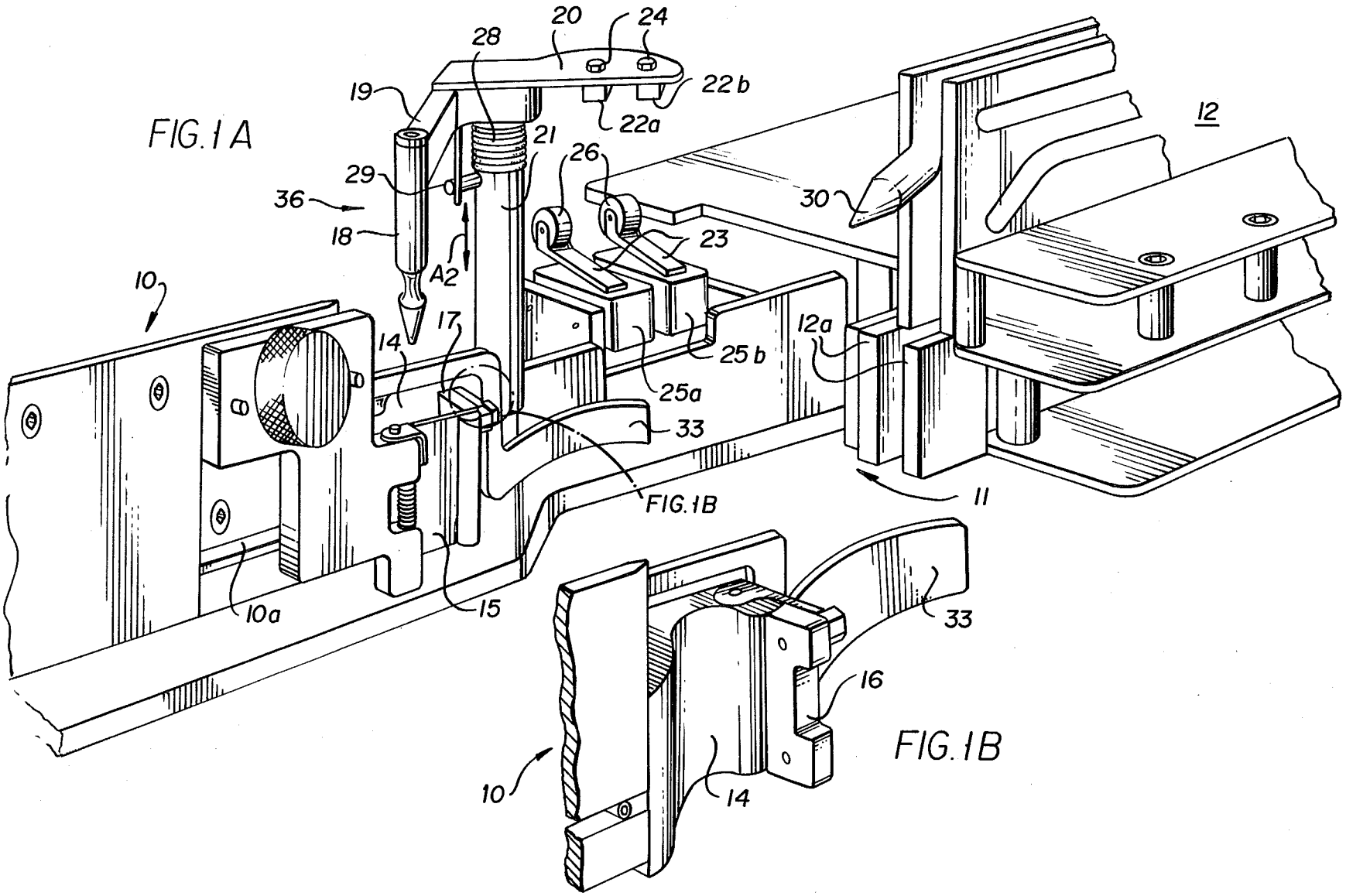

FIG.1B 12
11
30
12a
25b
23
22b
24
22a
20
26
25a
33

21
28
42
17
15
19
29
18
14
36
10a
10

33
16
14
10

BAGGING MACHINES

This invention relates to improvements in bagging machines.

Bagging machines which operate on a chain of interconnected bags passing therethrough are known. For example there is known a machine for filling plastic bags of the type which are commonly referred to as Minigrip (trademark) bags. These bags are made in accordance with bag constructions developed and patented by Minigrip Inc. of USA. The Minigrip bag has a closure arrangement formed with the mouth of the bag whereby the sides of the bag can be pressed together and closed by a mechanical type coupling. This coupling is formed by an elongate grooved portion along one side of the bag and a shaped elongate projection extending along the other side of the bag, the projection being able to engage in the grooved portion and be retained therein.

In order to process such bags through the aforementioned bagging machine, the bags are formed in a chain link arrangement with adjacent bags being coupled by a small weld at or near the vicinity of the end of the "zipper" forming the mouth closure arrangement. This known machine operates on the basis of mechanical indexing means for drawing the chain of bags through the machine whereby individual bags can be successively filled with product and the filled bag which is at any one time the leading bag in the chain being severed from the chain.

This form of machine has, however, not been successful in operation as the mechanical means of indexing the chain of bags relies for correctness of operation of the machine on the bags in the link, especially the bag in and/or approaching the filling zone, being always in the correct position to allow the various machine functions to be carried out. Correct adjustment of the machine is thus essential to ensure that, for example, slippage between the chain of bags and the means moving the chain does not occur. If the machine is incorrectly adjusted or if it falls out of adjustment during operation then the bags in the chain do not assume their correct positions, especially in the critical area of the filling zone and/or the lead up to the filling zone, and the machine consequently malfunctions. In addition the machine is of complex construction and relies for operation on a series of costly gear trains. Further the machine is not readily adjustable for handling different sized bags.

The object of the present invention is to provide a bagging machine which handles bags linked together in a chain-like arrangement, the machine being of a construction that the movement of the chain of bags is controlled such that the bags in the chain, especially those in the filling zone and lead up to the filling zone, can be precisely positioned.

Broadly the invention consists of a bagging machine comprising input and output guides through which a chain of bags can be drawn, a bag filling zone between said input and output guides wherein a bag in the chain can be located for filling, means for advancing said chain of bags through said machine, movable bag engagement means adapted to engage with a bag approaching said filling zone and be moved by said bag as it moves to said filling zone, sensing means which sense the movement of said engagement means, control means which interrupt said advancement means in response to the sensing means sensing a pre-determined position of said bag in the filling zone and means operative under control of the control means once said predetermined position has been reached to cause the bag in the filling zone to be opened to facilitate filling thereof.

Figure 2:
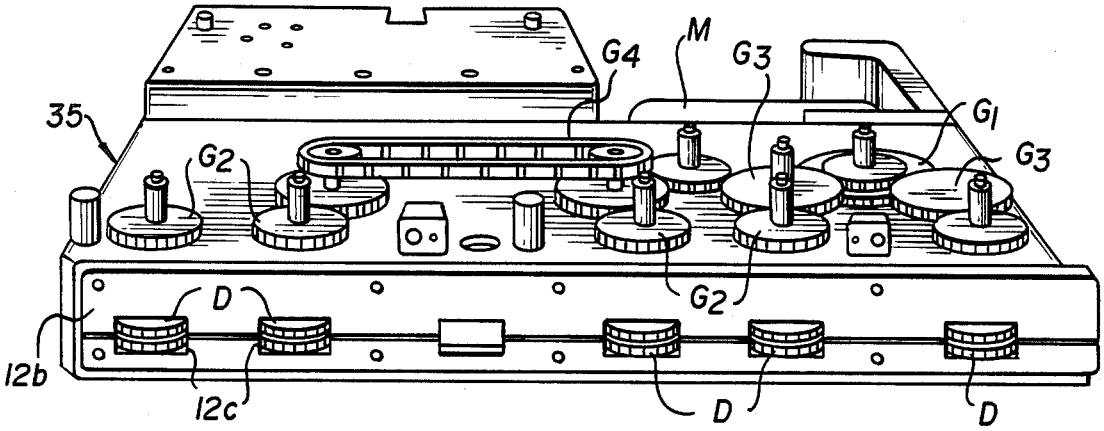
Figure 3:
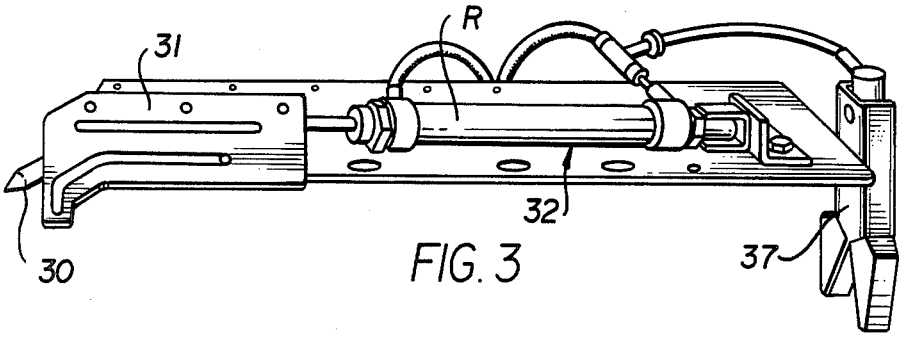
Figure 4:
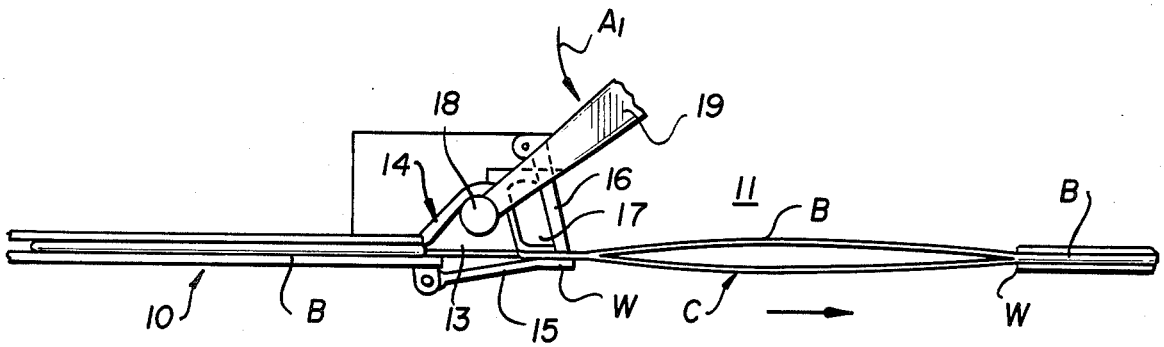

In the following more detailed description of the bagging machine according to the present invention reference will be made to the accompanying drawings in which:

FIGS. 1A and 1B are perspective views of the filling zone of the machine, FIG. 2 is a perspective view of part of the arrangement for drawing a chain of bags through the machine, FIG. 3 is a perspective view of the second engagement figure and clamping device, and FIG. 4 is a schematic plan view showing th chain of bags, input and output guides and finger engagement area.

The machine according to the present invention is designed to operate with bags which are linked together in a chain-like fashion. The bags are so linked that they are located side by side with the link being a small weld between the edges of adjacent bags, said weld being located at the open ends of the bags. To separate the bags the weld is broken and usually the leading filled bag of a chain is separated from the chain. However a chain of bags could, if desired, be filled and then separated one from the other as an operation separate from the machine. The bags can be of any suitable construction but the machine of the present invention is intended primarily for use with the aforementioned Minigrip bag. Accordingly the following description will refer to the machine processing.

The machine comprises an input guide 10 into which the leading end of a chain C of bags B is fed. The leading end of the chain is manually fed through said input guide 10 and passes a filling zone 11 and then is located in the input end of an output guide 12. These input and output guides 10 and 12 basically comprise a pair of spaced-apart guide surfaces between which the upper open ends of the bags are slidingly located. As the closure arrangement i.e. "zipper" of a Minigrip bag provides outwardly extending protrusions along each side of the bag near the open end thereof, a pair of ledges 10a and 12a are located in the spacing between the guide surfaces and these engage beneath the "zipper" of the bags to thus support the bags within the guides.

To impart movement to the chain of bags a plurality of drivewheels D are located in an opposed array either side of the surfaces forming the output guide 12 these wheels projecting into the guide through openings **12*c* in the guide surfaces 12*b*. Each drivewheel D has a non-slip surface up on the periphery thereof and the bags of the chain locate between the opposed pair of wheels to be engaged thereby. Suitable drive means impart rotation to all or some of the wheels so that the bags can be drawn through the output guide 12** in a controlled fashion.

According to the machine of the present invention the drive means is formed by a prime mover in the form of a speed controllable reversible electric motor M, the driveshaft of which is linked by suitable transmission means to the aforementioned drivewheels D. The transmission means can take many forms as will be appreciated by those skilled in the art. For example the pairs of drivewheels D can be geared together via gears $G_2$ (Only one of each pair being evident in FIG. 2) so that they move in unision. The electric motor M can be either direct coupled or indirectly coupled to an intermediate driveshaft driving a gear wheel $G_1$. The drive from the intermediate driveshaft is transmitted via gearwheel G, engaging with gearwheels $G_3$ which mesh directly with gearwheels $G_2$ or via chain drive $G_4$. The particular form of transmission means is well within the scope of the skills of the skilled person as are alternative drive means.

The input and output guides 10 and 12 are aligned one with the other with the output end of the input guide 10 being spaced from the input end of the output guide 12. The space between the two guides forms the filling zone 11 and preferably the space between the guides is adjustable to accommodate differing widths of bags B. For example the output guide and drive means can be formed as a movable unit 35 which can be adjusted in position relative to the input guide and thereby adjust the spacing between the guides.

A chain C of bags can thus be drawn through the machine and by controlling the movement of the chain each bag in the link is positioned at the filling zone 11 and can be filled with product to be bagged. The machine according to the present invention provides an arrangement whereby each bag entering the filling zone is precisely positioned so that for each filling operation the bag to be filled is located in the correct position.

Adjacent the output end of the input guide 10 is a mechanism (which is located in the area indicated by 36) for opening the bag which is about to leave the input guide. This mechanism is of known construction and operation, but basically it consists of a fixed non-slip surface on one guide surface and a movable non-slip surface which projects through the other guide surface opposite the fixed non-slip surface. The movable non-slip surface is movable linearly in the direction of movement of the bag so that one side of the bag moves relative to the other, thereby opening the leading end of the mouth of the bag such that the leading end of the mouth bows (as shown at 13) laterally outwardly. This bowing 13 of the bag occurs with the leading edge of the bag being located in a finger engagement area 14 positioned immediately adjacent to the output end of the input guide 10. This engagement area 14 is of a specified size and shape, being bounded by a pair of spring-loaded flaps 15 and 16. Preferably one flap 16 has a projecting portion 17 which serves to ensure that the area is of the required size and shape to closely accommodate the bowed leading end 13 of the bag B.

A vertically orientated engagement finger 18 is mounted at its upper end to a control arm 19 which is mounted with a mounting plate 20 all of which is attached to the upper end of a pivot shaft21. This arm 19 is thus able to pivot in the direction of arrow $A_1$. In addition the pivot shaft 21 can be moved upwardly and downwardly in the direction of arrows $A_2$ To facilitate further description of the construction of the machine the following will describe an operative cycle of the machine. The cycle commences with a chain C of bags extending through the machine with one product. The chain of bags is stationary and the engagement finger 18 is positioned as shown in the drawings but in lowered position such that it engaged in bag B. By the precise location of the bowed end 13 of the incoming bag the engagement finger 18 can be assured of correct location within the end of the bag. The weld W between the inter-engaged edges of the bag which has been filled and the incoming bag is located between the flaps 15 and 16 at the boundary of the engagement area 14.

To commence the cycle the prime mover M is actuated by a central control which is preferably a programmable logic controller PLC. The prime move drives the drivewheels D which draws the chain C along the output guide 12. This causes the incoming bag to move into the filling zone 11 and consequently the trailing edge of the mouth of the incoming bag B comes into contact with the engagement finger 18 and thus draws the finger with it. Located on the underside of the mounting plate 20 is at least one, but preferably two, projections **22*a* and 22*b* which are adjustable in position on the mounting plate 20. This adjustment is effected by each projection being mounted by a threaded stud which passes through a curved slot in the mounting plate. A lock nut 24** on the threaded stud locks the projection in its desired position.

Located beneath the mounting plate 20 are a pair of micro switches **25*a* and 25*b* each of which has a conventional actuating arm 23 with a roller 26 at the end thereof. As the control arm 19 moves in the direction of arrow $A_1$ the first projection 22*a* contacts the roller 26 of the corresponding micro switch 25*a*. Consequently the switch 25*a* is actuated and via the PLC the speed of the prime mover M is reduced thereby slowing the progress of the chain of bags through the machine. Subsequently the second projection 22*b* trips the second micro switch 25*b* which via the PLC stops the prime mover thereby halting the progress of the chain of bags. The cessation of movement of chain C is adjusted, by suitable location of the second projection 22*b*, so that the incoming bag has reached the position where the weld W between it and the following bag is located between the flaps 15 and 16 at the engagement area 14. Tripping of the second micro switch 25*b*** signals the PLC that the incoming bag is precisely located in the filling zone.

At this point the pivot shaft 21 is moved upwardly (arrow $A_2$) by suitable lifting means. Once again means to provide upward and downward movement of the pivot shaft will be well known to those skilled in the art and is not specifically shown in the drawings. Such lifting means can however be conveniently provided by a cam driven by a suitable drive means, such as an electric motor, the cam engaging with a follower on a pivoted arm. This arm is coupled to or engaged with the lower end of the pivot shaft 21 and thus upward and downward movement of the arm results in upward and downward movement of the pivot shaft. It will be appreciated that the pivot shaft is journalled in suitable bearings (one of which is shown at 27) to facilitate such movement.

Once the pivot shaft 21 has been lifted sufficiently for the engagement finger 18 to clear the bag the control arm 19 pivots back in a direction opposite to arrow $A_1$, this pivot movement being conveniently caused by a coil spring 28 on the shaft 21 acting against a projection 29 on the arm 19. The control arm 19 thus pivots back to a position where the engagement finger 18 is located (see FIG. 1) above the engagement area 14. The pivot shaft 21 is then moved downwardly such that the engagement finger 18 engages into the bowed leading end 13 of the mouth of the next incoming bag.

With the engagement finger 18 clear of the incoming bag the prime mover M is reversed by the PLC so that a reverse rotation of drivewheels D takes place. Prior to this or simultaneously therewith a second engagement finger 30 moves down into the leading end of the mouth of the bag in the filling zone. As shown in FIG. 3 the second engagement finger 30 is mounted by a mechanism linkage 31 so that it moves downs on an arc. The actual movement is created by a linear actuator 32 such as a pneumatic ram R. Once again it will be appreciated by those skilled in the art that there are many ways in which the second engagement finger 30 can be caused to move downwardly into the mouth of the bag.

The amount of reverse movement of the chain is controlled by programming the PLC to allow only a specified time during which the prime mover M operates in reverse. There is, however, also provided means of adjusting the speed of the prime mover. Hence the precise amount of reverse movement can be achieved to suit the size of bag being processed.

As the trailing edge of the mouth of incoming bag B is prevented from moving due to the presence of the flaps 15 and 16 the mouth of the bag opens because of the reverse movement of the leading end of the mouth. Opening of the mouth and indeed the bag is aided by a downwardly directed jet of air from a suitably positioned air nozzle (not shown) located above the filling zone. In addition the presence of the second engagement finger 30 within the area of the leading end of the mouth ensures that the sides of the bag move apart to open the bag rather than the two sides merely bowing together to one side.

Where the machine operates with an automatic product loading device i.e. a device which is actuated to drop product into the bag once it has been opened, it is preferable that a safety sensor be incorporated. This sensor senses the bag is open and in the event that the bag doesn't open the sensor shuts down the loader so that no product is dropped. This sensor can simply be a sensor arm 33 which is located adjacent to the top edge of the bag in the filling zone and positioned such that it is engaged when the bag is correctly opened. The sensor arm 33 is mounted by a micro switch (not shown) which is tripped by the arm moving. If the bag does not open correctly then the micro switch does not trip and by using reverse logic in the PLC the loading device is deactivated.

Prior to the bag being filled the second engagement finger 30 is retracted. Once filling has been completed the cycle is itself complete and the machine is then ready to recycle. As the next cycle commences the bag which has been filled is moved into the output guide 12 and this movement causes the zipper components to come together to close the bag in accordance with known techniques for machine closing of Minigrip bags.

Preferably the machine is provided with means for automatically separating each leading filled bag from the chain. This can be achieved by a pneumatically operated clamp 37 located at the outlet end of the output guide. The clamp is operated once the second micro switch **25*b*** trips so that the bag issuing from the outlet end is clamped prior to the prime mover reversing the direction of movement of the chain of bags. Consequently the bag is held fast when the chain movement is reversed and this causes the weld W between the bag and the next bag in the chain to break. The clamp can then be released to allow the bag to drop into a collection bin or chute. Alternatively the clamp can be formed as part of a robot arm which, after the weld has been severed, places the bag in a desired location.

Operation of the machine is controlled by the aforementioned programmable logic controller which operates in response to signals from the first and second micro switches **25*a* and 25*b*. As the second micro switch 25*b* trips each time at exactly the same position of the engagement finger 18** the actual position of the incoming bag is always precisely determined. Accordingly the various operations of the machine can be carried out automatically on the basis that the machine knows, rather than assumes (as is the case with known machines), the precise position of the bag. If for any reason an incoming bag does not correctly locate and this is sensed by the PLC and the machine shuts down and can sound an alarm to indicate that a malfunction situation has arisen.

The machine is capable of being quickly adapted to handle differnt sized bags. As mentioned earlier the physical size of the filling zone can be adjusted to accommodate the different sizes of bags. The PLC can be readily re-programmed to accept a difference in bag size. The extent of reverse movement of the chain can be readily adjusted by altering the time span of reverse operation of the prime mover as controlled by the PLC whilst fine adjustment is carried out by an operator adjusting (by a suitable manual control knob) th actual reverse speed of the prime mover.

The machine is of straightforward construction and can be of a compact and tidy design. By the use of the means of sensing the precise location of an incoming bag to the filling zone the machine senses the actual position of the machine so that the machine knows the precise location of the bag and thus functions which take place during a filling cycle can be correctly carried out. Unlike known machines therefore the machine does not assume the position of a bag and thus malfunctions which are the hallmark of such machines do not occur during operation of the machine according to the present invention.

We claim:

1. A bagging machine comprising input and output guides through which a chain of bags can be drawn, a bag filling zone between said input and output guides wherein a bag in the chain can be located for filling, means for advancing said chain of bags through said machine, movable bag engagement means adapted to engage with a bag approaching said filling zone and be moved by said bag as it moves to said filling zone, sensing means which sense the movement of said engagement means, control means which interrupt said advancement means in response to the sensing means sensing a pre-determined position of said bag in the filling zone, and means operative under control of the control means once said pre-determined position has been reached to cause the bag in the filling zone to be opened to facilitate filling thereof.

* * * * *